US010347980B2

(12) United States Patent
Miyagawa

(10) Patent No.: US 10,347,980 B2
(45) Date of Patent: Jul. 9, 2019

(54) ANTENNA DEVICE

(71) Applicant: Furuno Electric Co., Ltd., Nishinomiya (JP)

(72) Inventor: Tetsuya Miyagawa, Nishinomiya (JP)

(73) Assignee: Furuno Electric Co., Ltd., Nishinomiya (JP)

( * ) Notice: Subject to any disclaimer, the term of this patent is extended or adjusted under 35 U.S.C. 154(b) by 224 days.

(21) Appl. No.: 15/374,849

(22) Filed: Dec. 9, 2016

(65) Prior Publication Data

US 2017/0179588 A1 Jun. 22, 2017

(30) Foreign Application Priority Data

Dec. 22, 2015 (JP) ..... 2015-249184

(51) Int. Cl.

| | |
|---|---|
| ***H01Q 1/42*** | (2006.01) |
| ***H01Q 1/24*** | (2006.01) |
| ***H01Q 9/04*** | (2006.01) |
| ***H01Q 13/02*** | (2006.01) |
| ***H01Q 1/52*** | (2006.01) |

(Continued)

(52) U.S. Cl.

CPC ..... *H01Q 1/42* (2013.01); *H01Q 1/24* (2013.01); *H01Q 1/523* (2013.01); *H01Q 3/04* (2013.01); *H01Q 9/0407* (2013.01); *H01Q 13/02* (2013.01); *H01Q 21/065* (2013.01); *H01Q 21/08* (2013.01)

(58) Field of Classification Search

CPC ..... H01Q 1/42; H01Q 1/24; H01Q 1/523; H01Q 3/04; H01Q 13/02; H01Q 9/0407; H01Q 21/08; H01Q 21/065

See application file for complete search history.

(56) References Cited

U.S. PATENT DOCUMENTS 5,323,170 A * 6/1994 Lang ..... H01Q 1/42 343/705
2007/0057862 A1* 3/2007 Bailey ..... H01Q 1/32 343/872

(Continued)

FOREIGN PATENT DOCUMENTS

| | | | |
|---|---|---|---|
| JP | 3123777 | U | 7/2006 |
| JP | 2007201868 | A | 8/2007 |
| WO | 2015075072 | A1 | 5/2015 |

OTHER PUBLICATIONS

European Patent Office, Extended European Search Report Issued in Application No. 16205318.5, dated May 11, 2017, Germany, 9 pages.

*Primary Examiner* — Hoang V Nguyen
*Assistant Examiner* — Awat M Salih
(74) *Attorney, Agent, or Firm* — Alleman Hall Creasman & Tuttle LLP

(57) ABSTRACT

An antenna device is provided. The antenna device includes an antenna part, a motor and a case. The antenna part has a transmission antenna configured to transmit a radio wave and a reception antenna disposed on one of an upper side and a lower side of the transmission antenna and configured to receive a radio wave. The motor rotates the antenna part. The case covers the antenna part. The case has a side wall. The side wall has two inclined portions inclined at different inclination angles with respect to a rotational axis of the antenna part. A boundary between the two inclined portions is located higher than half of a height of the case.

16 Claims, 10 Drawing Sheets

(51) Int. Cl.

| | |
|---|---|
| ***H01Q 3/04*** | (2006.01) |
| *H01Q 21/06* | (2006.01) |
| *H01Q 21/08* | (2006.01) |

(56) References Cited

U.S. PATENT DOCUMENTS

| | | | | |
|---|---|---|---|---|
| 2010/0117923 | A1 | 5/2010 | Storz | |
| 2011/0037671 | A1 | 2/2011 | Vogler | |
| 2014/0159949 | A1* | 6/2014 | Mialhe | H01Q 1/281 342/26 B |

* cited by examiner

ANTENNA DEVICE

CROSS-REFERENCE TO RELATED APPLICATION(S)

This application claims priority under 35 U.S.C. § 119 to Japanese Patent Application No. 2015-249184, which was filed on Dec. 22, 2015, the entire disclosure of which is hereby incorporated by reference.

TECHNICAL FIELD

This disclosure mainly relates to a configuration of a radome type antenna device.

BACKGROUND

Conventionally, antenna devices accommodating a rotatable antenna in a radome are known. JP3123777U discloses this type of antenna device.

The antenna device of JP3123777U is provided with a reflection suppressing plate made of a material having an electrical property similar to that of the radome, inside of the radome at a position on a normal line and separated from the radome by substantially n-fourth ("n" is a positive odd number) of the wavelength of a radio wave. With the structure of JP3123777U, a reflection wave from the radome is canceled by the reflection suppressing plate, and thus an antenna gain reduction and an increase of sidelobes are suppressed.

Although a single antenna transmits and receives radio waves in the antenna device of JP3123777U, antenna devices including a transmission antenna and a reception antenna separated from each other like an FMCW (Frequency Modulated Continuous Wave) radar are also known. In such an antenna device, the transmission and reception of the radio waves are performed simultaneously, and therefore, it becomes important to secure isolation between the transmission and reception antennas.

However, if the radome of JP3123777U is applied to such an antenna device which performs the transmission and reception by the different antennas, the device will have a dual structure having a radome-like structure on the inside of the radome, which causes increases in weight and cost.

Further, it may also be considered to secure the isolation by separating the transmission antenna from the reception antenna in up-and-down directions of the antenna device. However, it will become difficult to reduce in size of the antenna device in the up-and-down directions.

Note that the antenna device of JP3123777U has a slightly inclined side wall of the radome. With an antenna device in which transmission and reception antennas are arranged in the up-and-down directions, by providing the inclination angle to the side wall of the radome as above, it is considered to be capable to improve the isolation characteristic to some extent. However, in order to secure a sufficiently high isolation characteristic, the side wall of the radome needs to be inclined sharply to some extent, which causes an increase in radome diameter.

SUMMARY

The purpose of the present disclosure relates to providing an antenna device which includes a radome reduced in size, with an improved isolation characteristic.

According to one aspect of this disclosure, an antenna device with the following configuration is provided. That is, the antenna device includes an antenna part, a motor and a case. The antenna part has a transmission antenna configured to transmit a radio wave and a reception antenna disposed on one of an upper side and a lower side of the transmission antenna and configured to receive a radio wave. The motor rotates the antenna part. The case covers the antenna part. The case has a side wall. The side wall has two inclined portions inclined at different inclination angles with respect to a rotational axis of the antenna part. A boundary between the two inclined portions is located higher than half of a height of the case.

Thus, compared to a conventional case where only one inclined portion is provided, isolation characteristics of the transmission antenna and the reception antenna are improved. Further, since the radius of a lower part of the radome is smaller than the case where the only one inclined portion is provided, the isolation is improved without increasing the size of the case. Moreover, since the highest boundary is located higher than half of the overall height, the radius of the lower part of the case is reduced even more.

Each of the transmission and reception antennas may have a horn. The boundary may be located higher than a lower end of the horn located lower than the other horn.

Thus, the radius of the lower part of the case is reduced further more while keeping the improvement of the isolation.

The inclination angle may be larger for a first inclined portion disposed at a higher position among the two inclined portions than for a second inclined portion disposed at a lower position thereamong.

Thus, compared to a case where the second inclined portion disposed at the lower position is inclined larger than the first inclined portion disposed at the higher position, the radius of the lower part of the case is reduced. As a result, a size increase of the antenna device is prevented while keeping the improvement of the isolation.

The inclination angle of the first inclined portion is 20° or above.

Thus, the improvement of the isolation is enhanced.

The inclination angle of the first inclined portion is approximately 25°, and the inclination angle of the second inclined portion is approximately 10°.

Thus, the isolation is improved more effectively.

The boundary may be at a same height over the entire circumference of the case.

Thus, the isolation is improved to substantially the same level over the entire circumference of the case. Further, the shape of the side wall of the case is simplified, thus the manufacturing of the case becomes easy.

The boundary may be located lower than an upper end of the horn located higher than the other horn.

Thus, the isolation is improved more effectively.

The boundary may be located at substantially three-fourth of the height of the case.

Thus, the isolation is improved more effectively.

The antenna part may transmit and receive an FMCW.

That is, the above configuration with the improved isolation is particularly suitable for a case of transmitting and receiving radio waves simultaneously.

The antenna part maybe a patch antenna.

Thus, the improvement of the isolation in the antenna device of the patch antenna type is enhanced.

BRIEF DESCRIPTION OF THE DRAWINGS

The present disclosure is illustrated by way of example and not by way of limitation in the figures of the accompanying drawings, in which the like reference numerals indicate like elements and in which.

DETAILED DESCRIPTION

Figure 1:
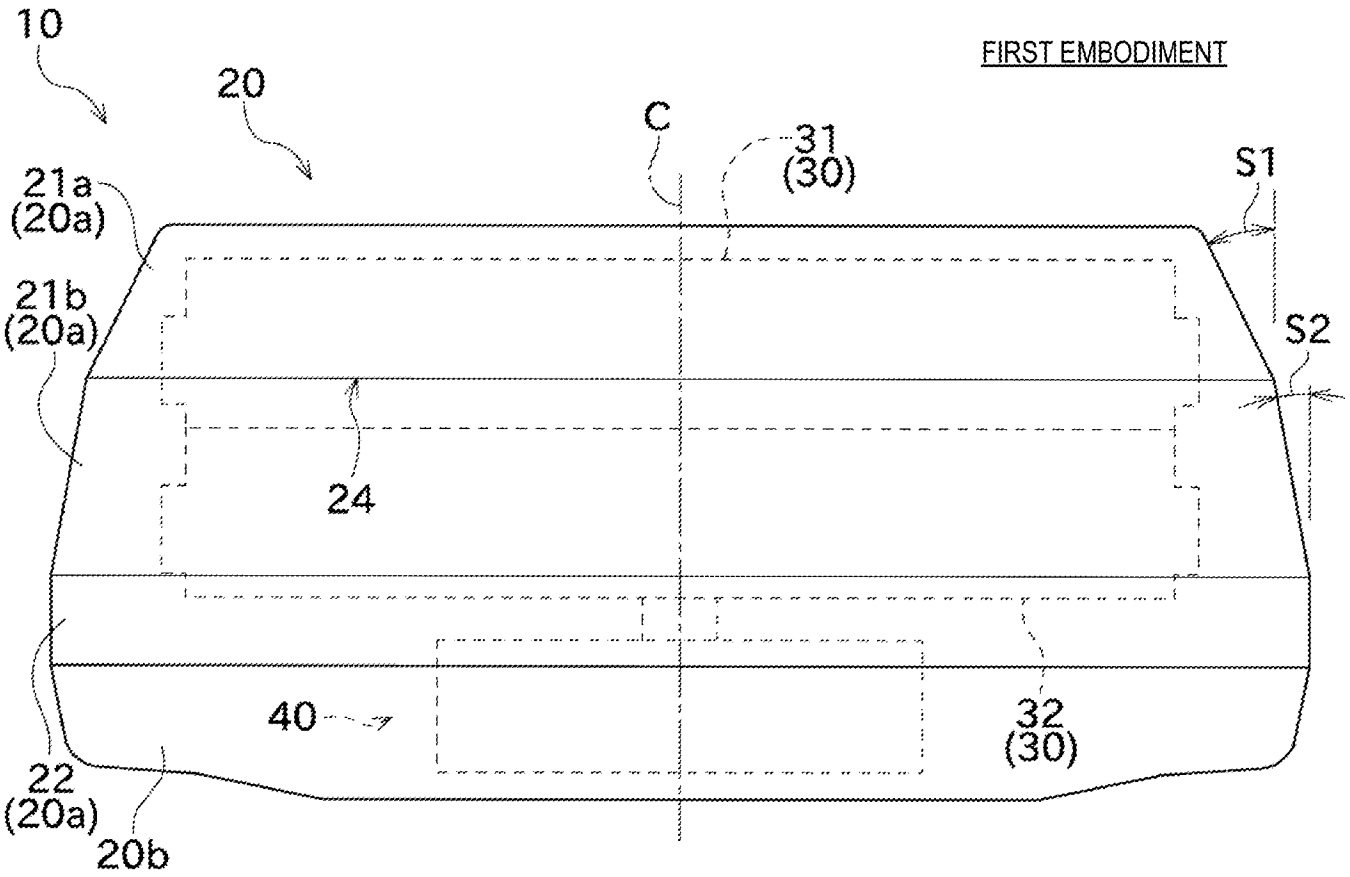
FIG. 1 is an elevational view illustrating an overall structure of an antenna device according to a first embodiment of this disclosure.
Figure 2:
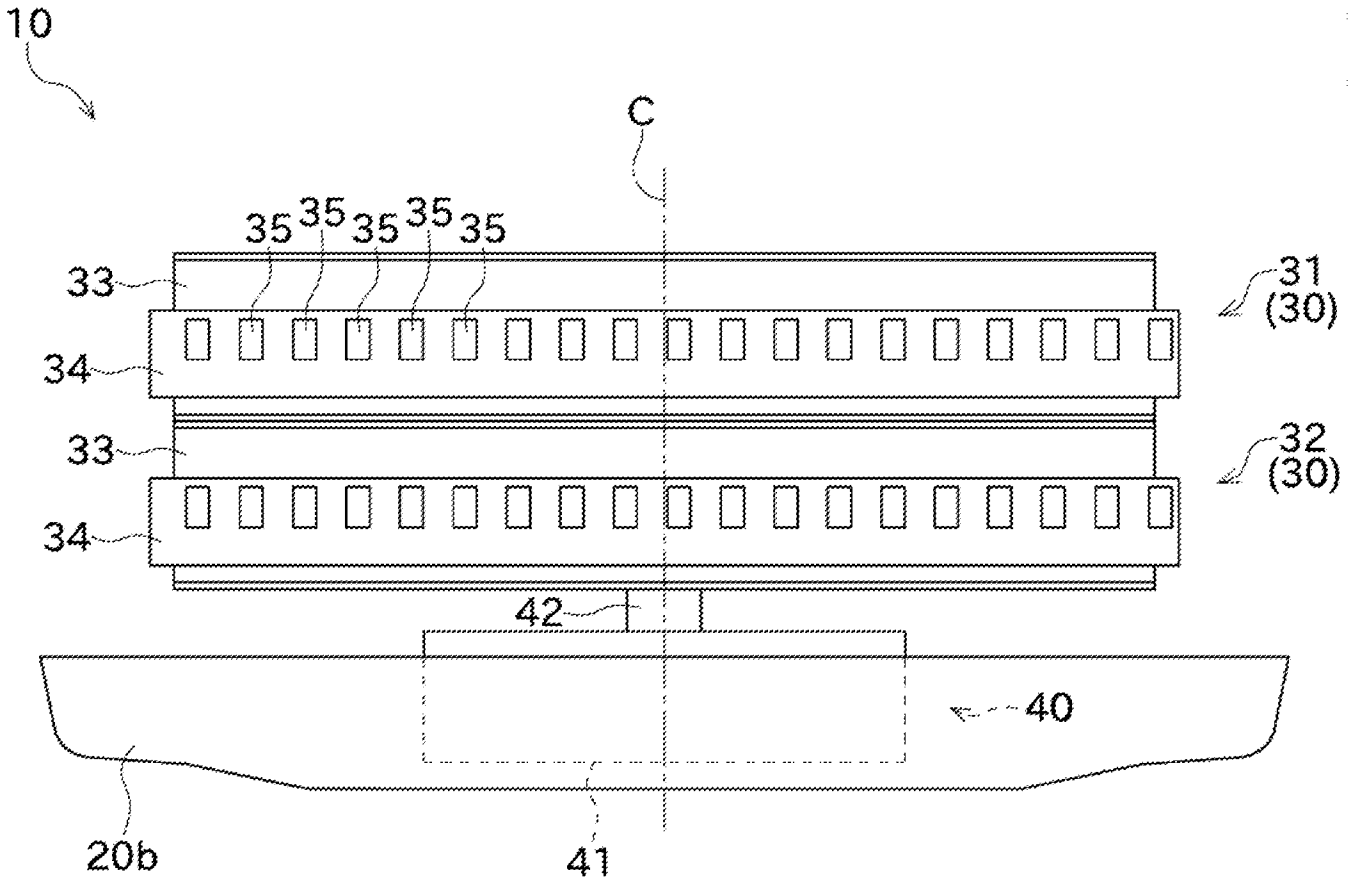
FIG. 2 is an elevational view illustrating an inside of a radome in a state where an antenna part is facing forward.
Figure 3:
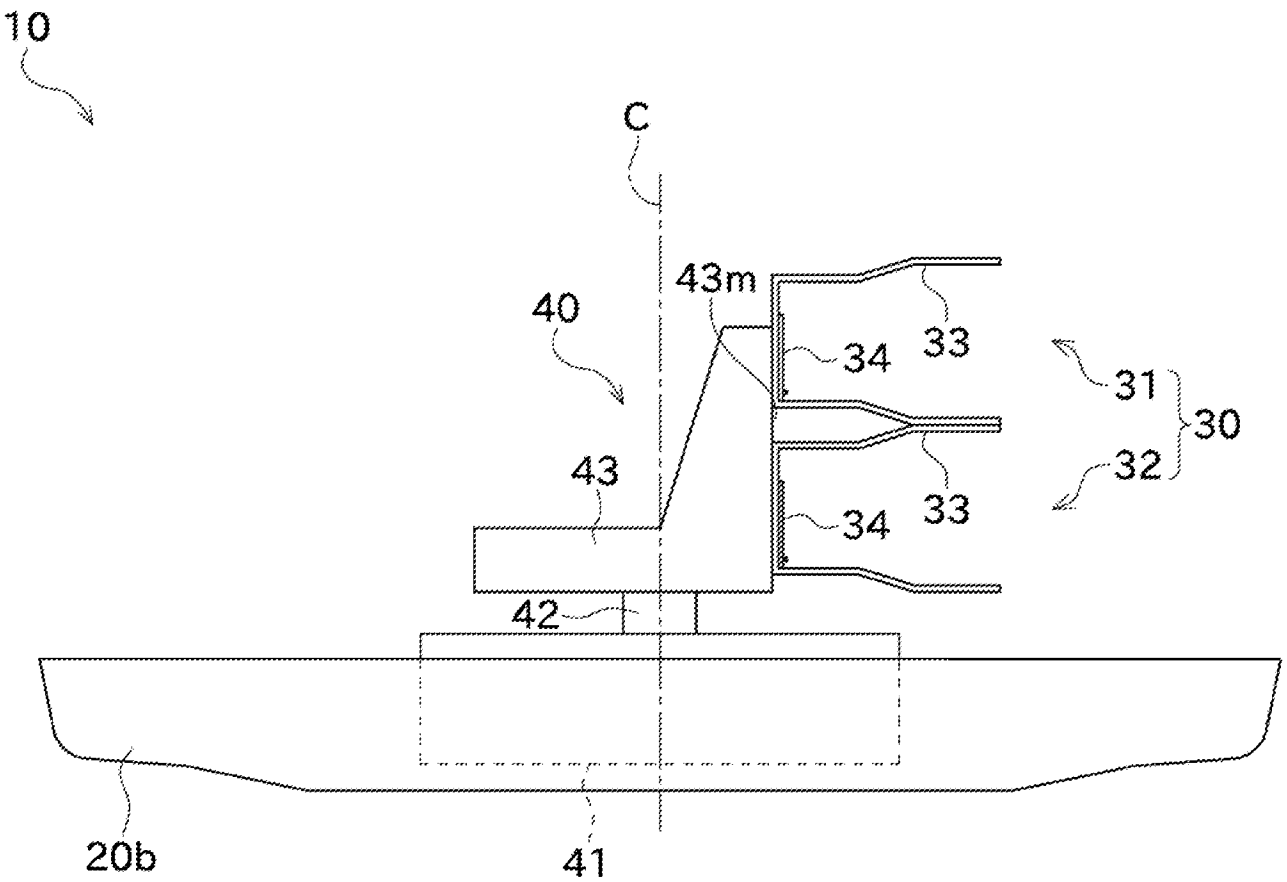
FIG. 3 is an elevational view illustrating the inside of the radome in a state where the antenna part is rotated by 90° from the orientation in FIG. 2.

One embodiment of this disclosure is described with reference to the appended drawings. FIG. 1 is an elevational view illustrating an overall structure of an antenna device 10 according to a first embodiment of this disclosure. FIG. 2 is an elevational view illustrating an inside of a radome 20 in a state where an antenna part 30 is facing forward. FIG. 3 is an elevational view illustrating the inside of the radome 20 in a state where the antenna part 30 is rotated by 90° from the orientation in FIG. 2.

As illustrated in FIG. 1, the antenna device 10 includes the radome (case) 20, the antenna part 30 of a patch antenna type, and a rotational mechanism 40. The antenna device 10 is used for a radar apparatus which is installed in a ship, for example.

The radome 20 is formed to be rotatable centering on a rotational axis of the rotational mechanism 40 (hereinafter, may be referred to as the center axis C). In the antenna device 10, the antenna part 30 transmits and receives radio waves while being rotated by the rotational mechanism 40 within the radome 20.

The radome 20 has a split structure in up-and-down directions, which is comprised of an upper cover 20*a* and a lower cover 20*b*, and the antenna part 30 and the rotational mechanism 40 may be accommodated in an internal space formed by joining the upper cover 20*a* with the lower cover 20*b*. Note that other components, structures, and/or configurations (e.g., an RF unit configured to process a high-frequency signal) may also be accommodated inside the radome 20. The upper cover 20*a* is removable from the lower cover 20*b*, and FIGS. 2 and 3 illustrate this removed state. The detailed configuration of the radome 20 is described later.

The rotational mechanism 40 includes a support base 41, a rotational shaft 42, and an attaching part 43 as illustrated in FIG. 3, etc. The support base 41 has, for example, a circular column shape and is fixed to the lower cover 20*b* of the radome 20 by a fixed member (not illustrated). The rotational shaft 42 is disposed in a center part of the antenna device 10 to extend in the up-and-down directions (in the center axis C), and is supported to the support base 41 to be relatively rotatable. The attaching part 43 is fixed to an upper part of the rotational shaft 42. The attaching part 43 has a flat attaching surface 43*m* extending in parallel to the center axis C, and the antenna par 30 is attached to this attaching surface 43*m*.

The rotational mechanism 40 includes a drive source (e.g., electric motor, not illustrated) disposed inside the radome 20. The drive force from this drive source is transmitted to the rotational shaft 42 via a drive force transmission member (e.g., gears and belt(s), not illustrated), thus the antenna part 30 rotates on a horizontal plane centering on the center axis C.

The antenna part 30 transmits and receives FMCWs (Frequency Modulated Continuous Waves) as the radio waves, and includes a transmission antenna 32 and a reception antenna 31. The transmission antenna 32 and the reception antenna 31 are arranged in the up-and-down directions and both of them are fixed to the attaching part 43 (attaching surface 43*m*). The antenna part 30 is capable of transmitting the radio wave by the transmission antenna 32 and receiving the radio wave by the reception antenna 31 simultaneously.

Each of the transmission antenna 32 and the reception antenna 31 includes a horn 33 and a patch antenna base plate 34.

The horn 33 is structured by a metal plate and opens at one side farther from the center axis C. As illustrated in FIG. 3, the horn 33 is formed with a tapered portion so that the opening area becomes gradually larger in the up-and-down directions as it extends away from the patch antenna base plate 34.

As illustrated in FIG. 2, the patch antenna base plate 34 is formed with a plurality of patch antennas 35 disposed along a horizontal straight line. Note that although an electric power path is not illustrated in FIG. 2, each patch antenna 35 is supplied with power by a microstripline.

The horn 33 of the reception antenna 31 and the horn 33 of the transmission antenna 32 are disposed to be in contact with each other (note that, a small gap may be formed between the two horns 33). Thus, by disposing the reception antenna 31 and the transmission antenna 32 to be in contact or close to each other, the antenna device 10 is structured compactly particularly in the height (up-and-down) directions.

Figure 4:
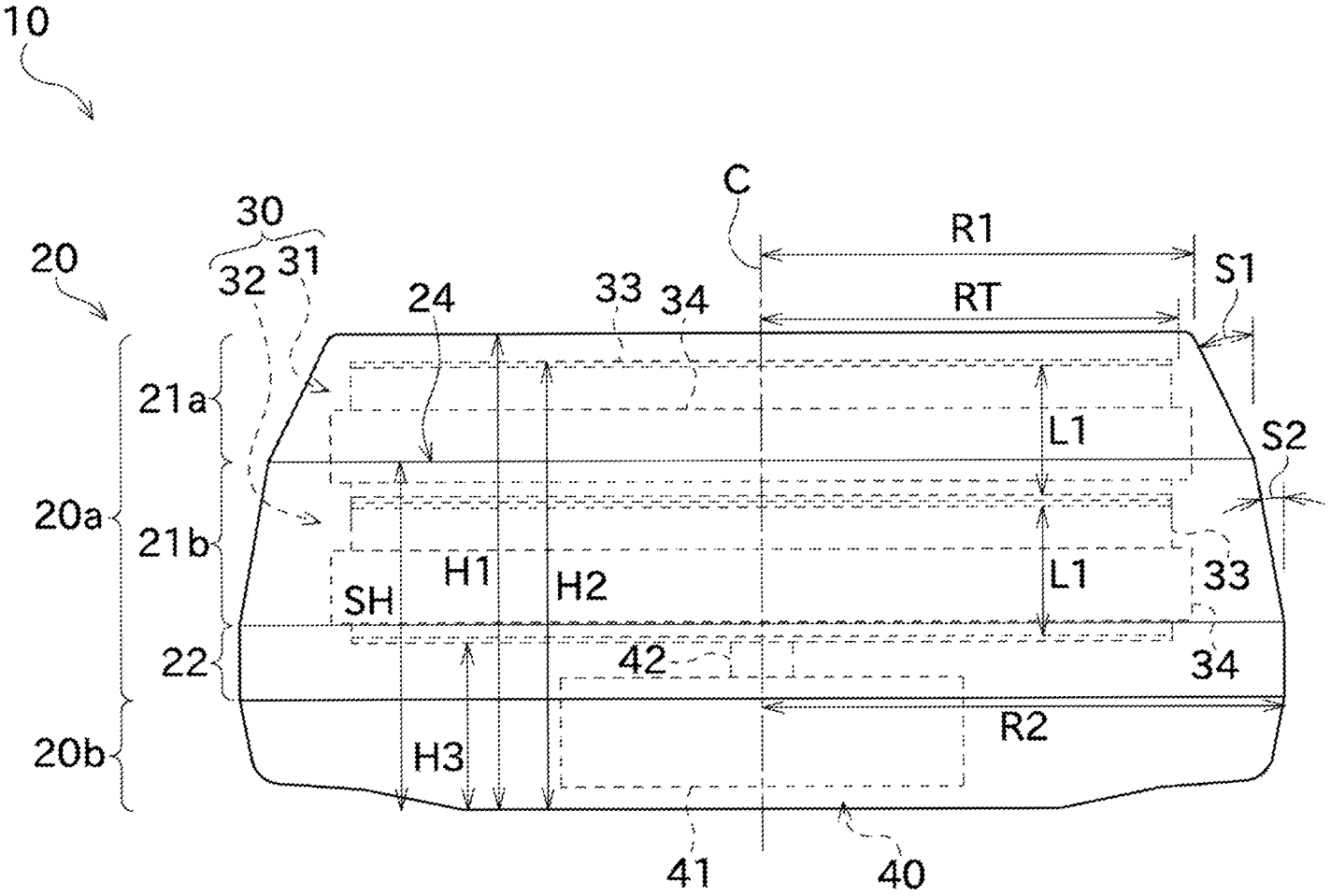
FIG. 4 is an elevational view illustrating a detailed structure of the radome and the antenna part.
Figure 5:
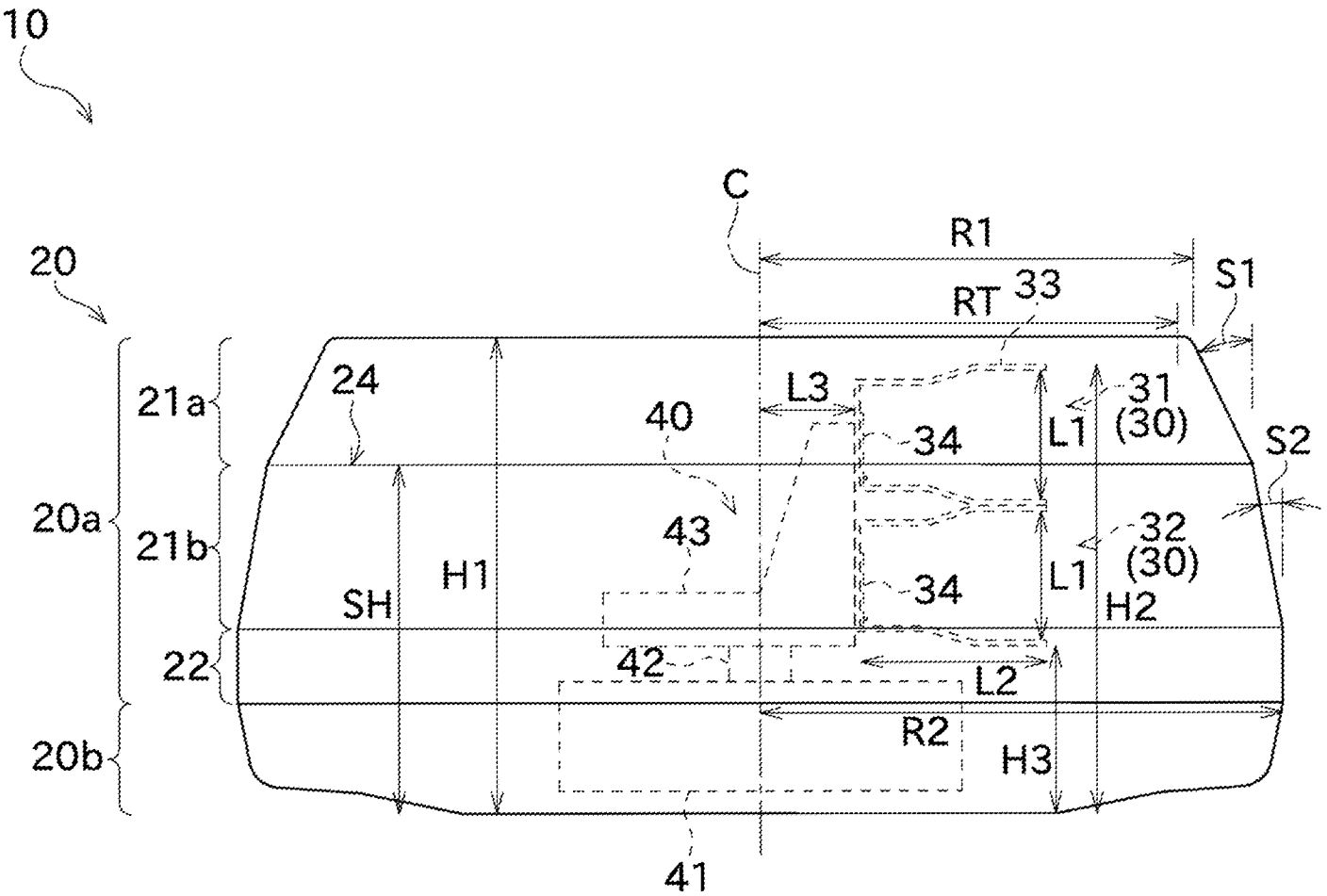
FIG. 5 is an elevational view illustrating a detailed structure of the radome and the antenna part in a state where the antenna part is rotated by 90° from the orientation in FIG. 4.

Next, the structure of the radome 20 is described in detail mainly with reference to FIGS. 4 and 5. FIG. 4 is an elevational view illustrating a detailed structure of the radome 20 and the antenna part 30. FIG. 5 is an elevational view illustrating a detailed structure of the radome 20 and the antenna part 30 in a state where the antenna part 30 is rotated by 90° from the orientation of FIG. 4.

The radome 20 covers the surrounding of the antenna part 30 and the rotational mechanism 40 to protect the antenna part 30 from wind, rain, etc. The radome 20 is made of a material having a property to transmit the radio wave well (e.g., reinforced plastic).

The upper cover 20*a* is fixed to the lower cover 20*b* by a fixing member, such as bolts, screws and studs.

The upper cover 20*a* is formed to be rotatable (e.g., has a shape formed by joining a frustoconical and a circular cylinder with each other). The upper cover 20*a* is hollow and has an upper wall and a side wall extending downward from an end of the upper wall. The upper wall is disposed to cover the upper side of the antenna part 30 etc., and the side wall is disposed to horizontally cover sides of the antenna part 30 etc. The upper wall is formed substantially into a circle and flat, and the side wall has a circular shape in a cross section taken by being cut with an imaginary horizontal plane.

The side wall of the upper cover 20*a* has a plurality of (two) inclined portions 21*a* and 21*b* having different inclining angles, and a non-inclined portion 22. The two inclined portions 21*a* and 21*b* are connected with each other in the up-and-down directions. The inclination angle changes at the boundary between the first (upper side) inclined portion 21*a* and the second (lower side) inclined portion 21*b*, and this section may be referred to as "the inclination changing boundary 24" or simply "the boundary 24."

The two inclined portions 21*a* and 21*b* are integrally formed. Further, the first (upper side) inclined portion 21*a* is integrally formed with the upper wall.

The first and second inclined portions 21*a* and 21*b* incline at different angles with respect to the center axis C. A first inclination angle S1 which is an inclination angle of the first inclined portion 21*a* is larger than a second inclination angle S2 which is an inclination angle of the second inclined portion 21*b*. Note that each inclination angle mentioned here is an angle of the side wall with respect to a vertical line (i.e., parallel to the center axis C) in a cross section taken by cutting the upper cover 20*a* with an imaginary plane including the center axis C. Thus, the second inclined portion 21*b* is oriented closer to the direction of the center axis C compared to the first inclined portion 21*a*.

The non-inclined portion 22 is formed in parallel to the center axis C. In other words, the non-inclined portion 22 has zero inclination angle. The non-inclined portion 22 is integrally formed with the second inclined portion 21*b*.

Next, to describe influences which are caused on an isolation characteristic due to the inclination angle of the radome side wall, a conventional antenna device 10*p* is described with reference to FIG. 6, which is an elevational view of the conventional antenna device 10*p*.

Figure 6:
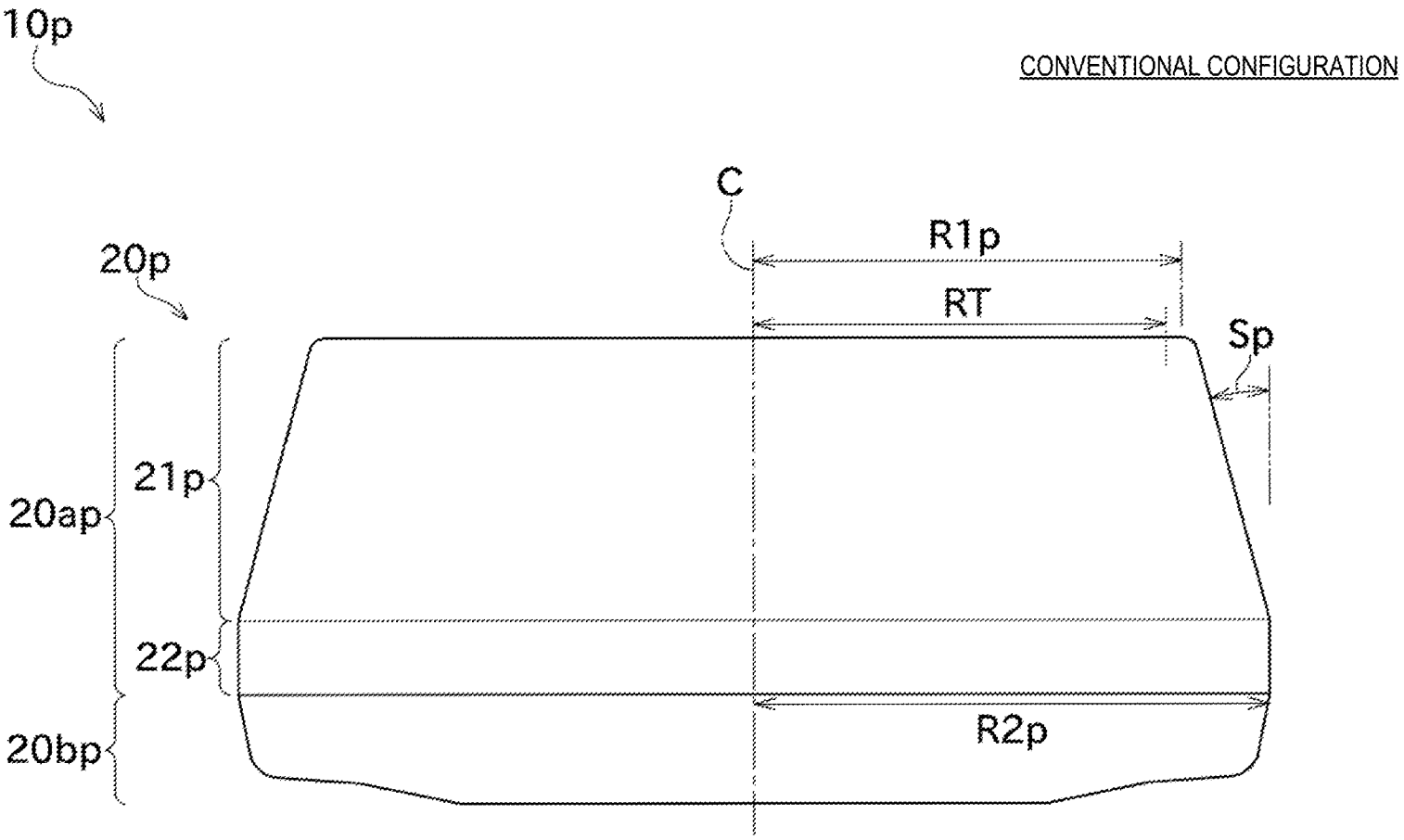
FIG. 6 is an elevational view illustrating a conventional antenna device provided with a single inclined portion.

In the conventional antenna device 10*p* illustrated in FIG. 6, a radome 20*p* is comprised of an upper cover 20*ap* and a lower cover 20*bp*. Unlike the embodiment described above, a side wall of the radome 20*p* (upper cover 20*ap*) is formed with a single inclined portion 21*p*. The upper cover 20*ap* has the inclined portion 21*p* and a non-inclined portion 22*p*. The inclined portion 21*p* is formed to incline by an inclination angle Sp with respect to the vertical line.

Figure 7:
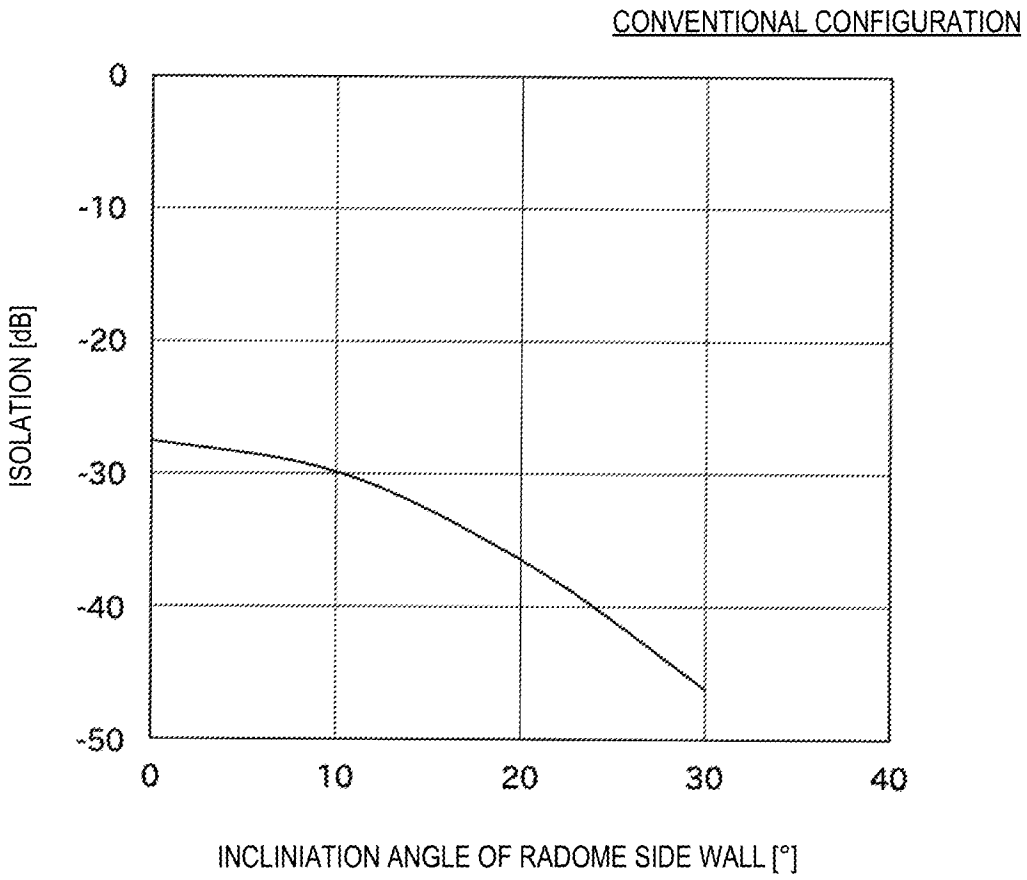
FIG. 7 is a chart illustrating a relationship between an inclination angle of a radome side wall and an isolation value, in the conventional antenna device.

FIG. 7 is a chart illustrating a change in an isolation value according to the inclination angle Sp of the side wall of the radome 20*p*, in the conventional antenna device 10*p* illustrated in FIG. 6. Note that, for the sake of easier comparison, the isolation characteristic is obtained by a simulation calculation, under a condition that an antenna part having the same configuration as the antenna part 30 of this embodiment is accommodated in the conventional antenna device 10*p*. This chart indicates that the isolation characteristic is improved by increasing the inclination angle Sp of the side wall of the radome 20*p*. For example, it is understood that the isolation characteristic improves by approximately 10 times by changing the inclination angle Sp of the side wall of the radome 20*p* from approximately 10° to approximately 24°.

As described above, inclining the side wall of the radome 20*p* is an effective scheme of improving the isolation characteristic. On the other hand, although a radius R1*p* of an upper part of the radome 20*p* needs to be larger than a radius RT of a locus of rotation of an upper end portion of the antenna part, since the antenna part needs to be wide in order to secure directivity, it is practically almost impossible to reduce the radius R1*p*. Therefore, there is no way but to increase a radius R2*p* of a lower part of the radome 20*p* as the inclination angle Sp of the inclined portion 21*p* is increased; however, this causes a difficulty in size reduction.

Next, the isolation characteristic obtained based on the shape and configuration of the radome 20 of this embodiment is described with reference to FIGS. 4, 5, 8 etc.

As described above, the radome 20 of this embodiment includes the first inclined portion 21*a* and the second inclined portion 21*b*. The first and second inclined portions 21*a* and 21*b* are adjacent to each other in the up-and-down directions over the inclination changing boundary 24. The inclination angle of the first inclined portion 21*a* (first inclination angle S1) is larger than the inclination angle of the second inclined portion 21*b* (second inclination angle S2), i.e., S1>S2. Further, the radome 20 is rotatable about the center axis C described above.

As illustrated in FIGS. 4 and 5, a radius R1 of the upper part of the radome 20 is larger than the radius RT of the lotus of rotation of the upper end portion of the antenna part 30 (R1>RT) so as to accommodate the antenna part 30 inside the radome 20.

Further, the height of the inclination changing boundary 24 (inclination changing height SH) is substantially three-fourth of the height of the radome 20 (radome height) H1, i.e., the inclination changing height SH is higher than half of the radome height H1 (SH>H1/2). Moreover the inclination changing height SH is higher than a height H3 of a lower end of the antenna part 30 (SH>H3). Furthermore, the inclination changing height SH is lower than a height H2 of the upper end of the antenna part 30 (SH<H2). Note that in the antenna part 30 of this embodiment, since the reception antenna 31 is disposed on the transmission antenna 32, the height H2 of the upper end of the antenna part 30 means the height of an upper end of the horn 33 of the reception antenna 31, and the height H3 of the lower end of the antenna part 30 means the height of a lower end of the horn 33 of the transmission antenna 32.

As illustrated in FIG. 5, the horns 33 of the transmission and reception antennas 32 and 31 are structured so that each opening thereof has a length L1 in the up-and-down directions and a depth L2. Further a length from the antenna part 30 to the center axis C is L3.

Figure 8:
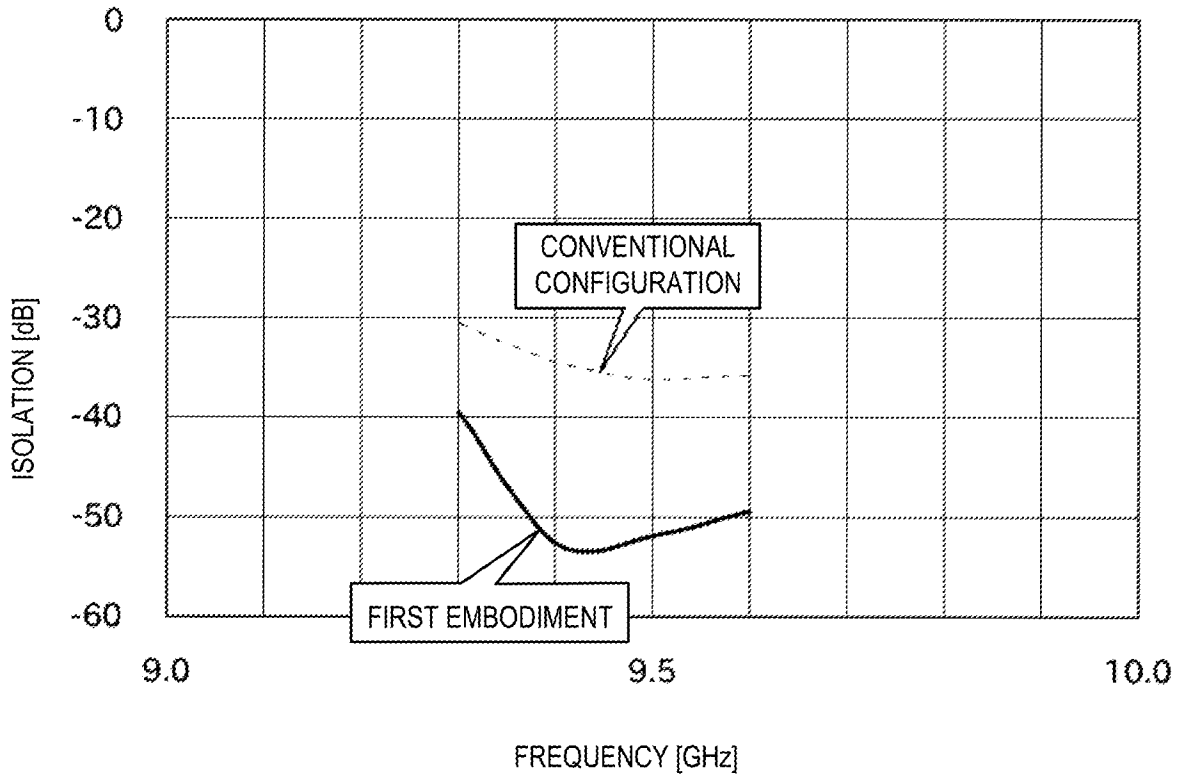
FIG. 8 is a chart illustrating a relationship between a frequency and an isolation value in the first embodiment.

FIG. 8 illustrates a simulation result indicating the isolation characteristic when the first inclination angle S1 is 25° and the second inclination angle is 10° in the antenna device 10 of the first embodiment having the above configuration. In the chart of FIG. 8, the horizontal axis is the frequency of the radio wave transmitted and received by the antenna part 30, and the vertical axis is the isolation value. The chart of FIG. 8 also illustrates the isolation characteristic of the antenna device 10*p* with the conventional configuration. Note that the frequency of the radio wave is within a suitable frequency range of 9 GHz, and in the conventional configuration, in view of making the radius R2*p* of the lower part of the upper cover 20*ap* substantially the same as the radius R2 of the lower part of the upper cover 20*a* of the first embodiment, the inclination angle Sp is set to about 15°.

As illustrated in FIG. 8, with the radome 20 of this embodiment provided with the two inclined portions 21*a* and 21*b*, compared to the radome 20*p* having the conventional structure provided with only the single inclined portion 21*p*, the isolation value is lowered to substantially one-tenth or below at all frequencies at which the simulation is performed. Thus it is understood that the isolation characteristic is improved by 10 times or more in the radome 20 of this embodiment compared to the radome 20*p* having the conventional structure. With the radome 20 of this embodiment, the isolation value is substantially −40 dB or below over the entire range of frequency at which the simulation is performed, and a suitable isolation characteristic is achieved.

As described above, in the antenna device 10 of this embodiment, the two inclined portions 21*a* and 21*b* with different inclination angles are formed in the radome 20. Further, the inclination changing height SH which is the height of the boundary between the two inclined portions 21*a* and 21*b* (the height at which the inclination angle changes) is substantially three-fourth of the radome height H1 which is the overall height of the radome 20, i.e., higher than half of the radome height H1, further higher than the lower end of the horn 33 of the transmission antenna 32, and lower than the upper end of the horn 33 of the reception antenna 31. Thus, the isolation characteristic is effectively improved while preventing the radius R2 of the lower part of the radome 20 from increasing.

Note that the inclination angle S1 of the first inclined portion 21*a* and the inclination angle S2 of the second inclined portion 21*b* are not limited to the above-illustratively-described angles, and may variously be changed; however, it becomes easier to achieve the suitable isolation value (e.g., −40 dB) if the first inclination angle S1 is 20° or above. Moreover, it becomes even easier to achieve the suitable isolation value if the first inclination angle S1 is approximately 25° and the second inclination angle S2 is approximately 10°.

Moreover, in this embodiment, the inclination angle S1 of the first (upper side) inclined portion 21*a* is larger than the inclination angle S2 of the second (lower side) inclined portion 21*b* (S1>S2). Thus, the shape of the radome 20 is prevented from becoming pointy and a smooth and beautiful appearance is achieved.

Further, since the radome 20 is formed to be rotatable about the rotational axis of the rotational mechanism 40 (center axis C), the inclination changing height SH is the same over the entire circumference of the radome 20. In other words, the inclination changing boundary 24 is horizontal. Thus, it is possible to improve the isolation to substantially the same level in any orientation of the antenna part 30. Moreover, the shape of the radome 20 is simplified, thus the manufacturing becomes easy.

As described above, the antenna device 10 of this embodiment includes the antenna part 30, the rotational mechanism 40, and the radome 20. The antenna part 30 has the transmission antenna 32 and the reception antenna 31. The transmission antenna 32 transmits the radio wave. The reception antenna 31 is disposed on the transmission antenna 32 and receives the radio wave. The rotational mechanism 40 rotates the antenna part 30. The radome 20 covers the antenna part 30 in the rotating direction of the antenna part. The side wall of the radome 20 has the two inclined portions 21*a* and 21*b*. The two inclined portions 21*a* and 21*b* incline at the different inclination angles S1 and S2 with respect to the rotational axis of the antenna part 30 (center axis C). The inclination changing boundary 24 which is the boundary between the inclined portions 21 is located higher than half of the radome height H1 which is the overall height of the radome 20.

Thus, compared to the conventional case where only the single inclined portion 21*p* is provided, the isolation characteristics of the transmission antenna 32 and the reception antenna 31 are improved. Further, since the radius R2 of the lower part of the radome 20 is smaller than the case where the single inclined portion 21 is provided, the isolation is improved without increasing the size of the radome 20. Moreover, since the height position of the inclination changing boundary 24 is located higher than half of the radome height H1, the radius R2 of the lower part of the radome 20 is reduced even more.

Figure 9:
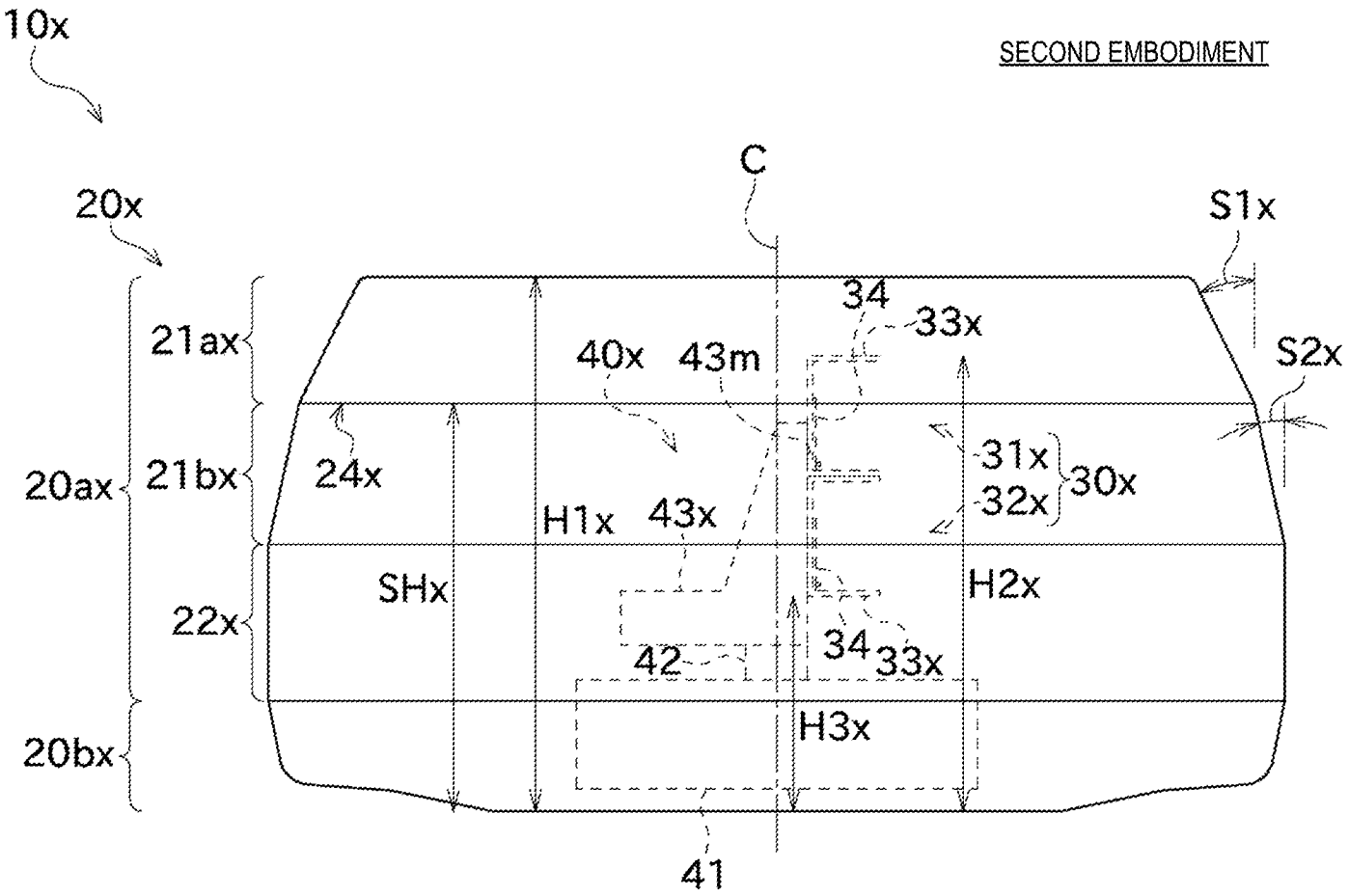
FIG. 9 is an elevational view illustrating a detailed structure of a radome and an antenna part in a state where the antenna part is facing a lateral side, in an antenna device of a second embodiment.

Next a second embodiment is described. FIG. 9 is an elevational view illustrating a detailed structure of a radome 20*x* and an antenna part 30*x* in a state where the antenna part 30*x* is facing a lateral side (a direction perpendicular to height directions of the case), in an antenna device 10*x* of a second embodiment. Note that in the description of this embodiment, components which are the same or similar to those of the first embodiment are denoted with the same reference characters in the drawing, and the description thereof may be omitted.

As illustrated in FIG. 9, the antenna device 10*x* of this embodiment includes the radome 20*x*, the antenna part 30*x*, and a rotational mechanism 40*x*.

The rotational mechanism 40*x* includes an attaching part 43*x* having an attaching surface 43*m* to which the antenna part 30*x* is fixed. The attaching surface 43*m* is located closer to the center axis C compared to the first embodiment. Further the antenna part 30*x* is comprised of a reception antenna 31*x* and a transmission antenna 32*x*, each having a horn 33*x* which does not have a tapered portion like the first embodiment and is formed short in length.

The radome 20*x* includes an upper cover 20*ax* and a lower cover 20*bx*. A side wall of the upper cover 20*ax* has two inclined portions 21*ax* and 21*bx*, and a non-inclined portion 22*x*. An inclination angle S1*x* of the upper inclined portion 21*ax* is different from an inclination angle S2*x* of the lower inclined portion 21*bx*. Also in this embodiment, an inclination changing height SHx which is the height of the boundary between the inclined portions 21*ax* and 21*bx* (inclination changing boundary 24*x*) is substantially three-fourth of the overall height of the radome 20*x* (radome height H1*x*). That is, the inclination changing height SHx is higher than half of the radome height H1*x*, further higher than a height H3*x* of a lower end of the horn 33*x* of the transmission antenna 32*x*, and lower than a height H2*x* of an upper end of the horn 33*x* of the reception antenna 31*x*.

Figure 10:
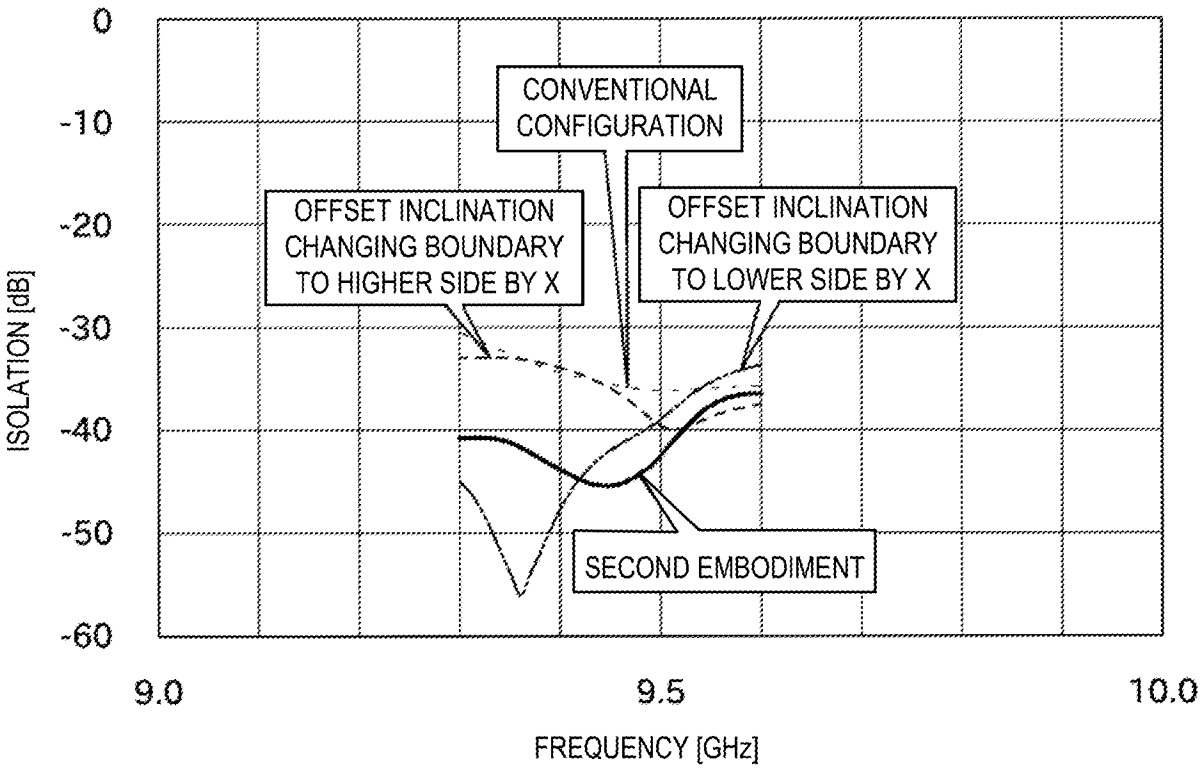
FIG. 10 is a chart illustrating a relationship between a frequency and an isolation value in the second embodiment.

The chart of FIG. 10 illustrates an isolation characteristic of the antenna device 10*x* of this embodiment in comparison with the conventional antenna device 10*p*, and it is understood that the configuration of this embodiment achieves a substantially suitable isolation characteristic.

Also in this embodiment, as long as the conditions described above are satisfied, the height of an inclination changing boundary 24*x* may suitably be changed. The chart of FIG. 10 also illustrates isolation characteristics of a case where the height of the inclination changing boundary 24*x* illustrated in FIG. 9 is offset to the higher side by a given distance and a case where the height of the inclination changing boundary 24*x* is offset to the lower side by the same distance, and it is understood that it is effective to suitably adjust the height of the inclination changing boundary 24*x* according to the circumstance such as a frequency to be used.

Although the suitable embodiments of this disclosure are described as above, the above configuration may be changed as follows, for example.

In the first embodiment, the radome 20 is formed with the two inclined portions 21*a* and 21*b*; however, the number of the inclined portions is not limited to two, and may be three or more. In this case, a plurality of inclination changing boundaries 24 will be formed. Here, any on of the inclination changing boundary 24, especially the inclination changing boundary 24 at the highest position among the plurality of inclination changing boundaries 24 is simply required to be higher than half of the height of the radome height H1. The same condition may be applied to the second embodiment.

Further, in the antenna parts 30 and 30*x*, the transmission antennas 32 and 32*x* may be disposed on the reception antennas 31 and 31*x*.

<Terminology>

It is to be understood that not necessarily all objects or advantages may be achieved in accordance with any particular embodiment described herein. Thus, for example, those skilled in the art will recognize that certain embodiments may be configured to operate in a manner that achieves or optimizes one advantage or group of advantages as taught herein without necessarily achieving other objects or advantages as may be taught or suggested herein.

All of the processes described herein may be embodied in, and fully automated via, software code modules executed by a computing system that includes one or more computers or processors. The code modules may be stored in any type of non-transitory computer-readable medium or other computer storage device. Some or all the methods may be embodied in specialized computer hardware.

Many other variations than those described herein will be apparent from this disclosure. For example, depending on the embodiment, certain acts, events, or functions of any of the algorithms described herein can be performed in a different sequence, can be added, merged, or left out altogether (e.g., not all described acts or events are necessary for the practice of the algorithms). Moreover, in certain embodiments, acts or events can be performed concurrently, e.g., through multi-threaded processing, interrupt processing, or multiple processors or processor cores or on other parallel architectures, rather than sequentially. In addition, different tasks or processes can be performed by different machines and/or computing systems that can function together.

The various illustrative logical blocks and modules described in connection with the embodiments disclosed herein can be implemented or performed by a machine, such as a processor. A processor can be a microprocessor, but in the alternative, the processor can be a controller, microcontroller, or state machine, combinations of the same, or the like. A processor can include electrical circuitry configured to process computer-executable instructions. In another embodiment, a processor includes an application specific integrated circuit (ASIC), a field programmable gate array (FPGA) or other programmable device that performs logic operations without processing computer-executable instructions. A processor can also be implemented as a combination of computing devices, e.g., a combination of a digital signal processor (DSP) and a microprocessor, a plurality of microprocessors, one or more microprocessors in conjunction with a DSP core, or any other such configuration. Although described herein primarily with respect to digital technology, a processor may also include primarily analog components. For example, some or all of the signal processing algorithms described herein may be implemented in analog circuitry or mixed analog and digital circuitry. A computing environment can include any type of computer system, including, but not limited to, a computer system based on a microprocessor, a mainframe computer, a digital signal processor, a portable computing device, a device controller, or a computational engine within an appliance, to name a few.

Conditional language such as, among others, "can," "could," "might" or "may," unless specifically stated otherwise, are otherwise understood within the context as used in general to convey that certain embodiments include, while other embodiments do not include, certain features, elements and/or steps. Thus, such conditional language is not generally intended to imply that features, elements and/or steps are in any way required for one or more embodiments or that one or more embodiments necessarily include logic for deciding, with or without user input or prompting, whether these features, elements and/or steps are included or are to be performed in any particular embodiment.

Disjunctive language such as the phrase "at least one of X, Y, or Z," unless specifically stated otherwise, is otherwise understood with the context as used in general to present that an item, term, etc., may be either X, Y, or Z, or any combination thereof (e.g., X, Y, and/or Z). Thus, such disjunctive language is not generally intended to, and should not, imply that certain embodiments require at least one of X, at least one of Y, or at least one of Z to each be present.

Any process descriptions, elements or blocks in the flow diagrams described herein and/or depicted in the attached figures should be understood as potentially representing modules, segments, or portions of code which include one or more executable instructions for implementing specific logical functions or elements in the process. Alternate implementations are included within the scope of the embodiments described herein in which elements or functions may be deleted, executed out of order from that shown, or discussed, including substantially concurrently or in reverse order, depending on the functionality involved as would be understood by those skilled in the art.

Unless otherwise explicitly stated, articles such as "a" or "an" should generally be interpreted to include one or more described items. Accordingly, phrases such as "a device configured to" are intended to include one or more recited devices. Such one or more recited devices can also be collectively configured to carry out the stated recitations. For example, "a processor configured to carry out recitations A, B and C" can include a first processor configured to carry out recitation A working in conjunction with a second processor configured to carry out recitations B and C. The same holds true for the use of definite articles used to introduce embodiment recitations. In addition, even if a specific number of an introduced embodiment recitation is explicitly recited, those skilled in the art will recognize that such recitation should typically be interpreted to mean at least the recited number (e.g., the bare recitation of "two recitations," without other modifiers, typically means at least two recitations, or two or more recitations).

It will be understood by those within the art that, in general, terms used herein, are generally intended as "open" terms (e.g., the term "including" should be interpreted as "including but not limited to," the term "having" should be interpreted as "having at least," the term "includes" should be interpreted as "includes but is not limited to," etc.).

For expository purposes, the term "horizontal" as used herein is defined as a plane parallel to the plane or surface of the floor of the area in which the system being described is used or the method being described is performed, regardless of its orientation. The term "floor" can be interchanged with the term "ground" or "water surface". The term "vertical" refers to a direction perpendicular to the horizontal as just defined. Terms such as "above," "below," "bottom," "top," "side," "higher," "lower," "upper," "over," and "under," are defined with respect to the horizontal plane.

As used herein, the terms "attached," "connected," "mated," and other such relational terms should be construed, unless otherwise noted, to include removable, moveable, fixed, adjustable, and/or releasable connections or attachments. The connections/attachments can include direct connections and/or connections having intermediate structure between the two components discussed.

Numbers preceded by a term such as "approximately", "about", and "substantially" as used herein include the recited numbers, and also represent an amount close to the stated amount that still performs a desired function or achieves a desired result. For example, the terms "approximately", "about", and "substantially" may refer to an amount that is within less than 10% of the stated amount. Features of embodiments disclosed herein are preceded by a term such as "approximately", "about", and "substantially" as used herein represent the feature with some variability that still performs a desired function or achieves a desired result for that feature.

It should be emphasized that many variations and modifications may be made to the above-described embodiments, the elements of which are to be understood as being among other acceptable examples. All such modifications and variations are intended to be included herein within the scope of this disclosure and protected by the following claims.

What is claimed is:

1. An antenna device, comprising:

an antenna part having a transmission antenna configured to transmit a radio wave and a reception antenna disposed on one of an upper side and a lower side of the transmission antenna and configured to receive a radio wave;

a motor configured to rotate the antenna part; and a case covering the antenna part, the case having a side wall, the side wall having a first inclined portion and a second inclined portion inclined at different inclination angles with respect to a rotational axis of the antenna part, a boundary between the first inclined portion and the second inclined portion being located higher than half of a height of the case, wherein the transmission antenna is configured to transmit the radio wave via the side wall, the reception antenna is configured to receive the radio wave via the side wall, each of the transmission and reception antennas has a horn, and the boundary is located higher than a lower end of a first horn located lower than a second horn.

2. The antenna device of claim 1, wherein an inclination angle is larger for the first inclined portion disposed at a higher position among the two inclined portions than for the second inclined portion disposed at a lower position thereamong.

3. The antenna device of claim 2, wherein the inclination angle of the first inclined portion is 20° or above.

4. The antenna device of claim 2, wherein the boundary is at a same height over the entire circumference of the case.

5. The antenna device of claim 2, wherein the boundary is located lower than an upper end of the second horn.

6. The antenna device of claim 2, wherein the boundary is located at substantially three-fourths of the height of the case.

7. The antenna device of claim 1, wherein the inclination angle of the first inclined portion is 20° or above.

8. The antenna device of claim 7, wherein the inclination angle of the first inclined portion is approximately 25°, and the inclination angle of the second inclined portion is approximately 10°.

9. The antenna device of claim 1, wherein the boundary is at a same height over the entire circumference of the case.

10. The antenna device of claim 9, wherein the boundary is located lower than an upper end of the second horn.

11. The antenna device of claim 9, wherein the boundary is located at substantially three-fourths of the height of the case.

12. The antenna device of claim 1, wherein the boundary is located at substantially three-fourths of the height of the case.

13. The antenna device of claim 1, wherein the boundary is located lower than an upper end of the second horn.

14. The antenna device of claim 13, wherein the boundary is located at substantially three-fourths of the height of the case.

15. The antenna device of claim 1, wherein the antenna part transmits and receives an FMCW.

16. The antenna device of claim 1, wherein the antenna part is a patch antenna.

* * * * *